US006580975B2

(12) United States Patent
Lovelace, II et al.

(10) Patent No.: US 6,580,975 B2
(45) **Date of Patent: *Jun. 17, 2003**

(54) REMOTE VERIFICATION OF SOFTWARE CONFIGURATION INFORMATION

(75) Inventors: John H. Lovelace, II, Erie, PA (US); Bradely Charles Hendrickson, Erie, PA (US); Gregory J. Fera, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/166,435

(22) Filed: Jun. 10, 2002

(65) Prior Publication Data

US 2003/0004622 A1 Jan. 2, 2003

Related U.S. Application Data

(63) Continuation of application No. 09/574,907, filed on May 19, 2000, now Pat. No. 6,430,481.
(60) Provisional application No. 60/162,294, filed on Oct. 28, 1999.

(51) Int. Cl.[7] ..... G06F 7/00
(52) U.S. Cl. ..... 701/19; 701/20
(58) Field of Search ..... 701/19, 20, 32, 701/34, 29

*Primary Examiner*—Yonel Beaulieu
(74) *Attorney, Agent, or Firm*—Carl A. Rowold; John L. DeAngelis, Jr.; Beusse Brownlee Bowdoin & Wolter, P.A.

(57) ABSTRACT

A method and apparatus for determining whether a railroad locomotive is configured with the correct software versions. The version numbers for software on board the vehicle are periodically determined by an on-board monitoring system. This information is later transmitted to a remote monitoring and diagnostic center, where the actual software version numbers are compared to the expected software versions. If there is a mismatch, personnel at the remote monitoring and diagnostic center are alerted to resolve the mismatch.

9 Claims, 2 Drawing Sheets

REMOTE VERIFICATION OF SOFTWARE CONFIGURATION INFORMATION

This patent application is a continuation of patent application Ser. No. 09/574,907, filed on May 19, 2000, now U.S. Pat. No. 6,430,481 issued on Aug. 6, 2002, and further claims the benefit of the U.S. provisional application filed on Oct. 28, 1999, and assigned application No. 60/162,294.

BACKGROUND OF THE INVENTION

The present invention is directed in general to monitoring operational parameters and fault-related information of a railroad locomotive, and more specifically, to a method and apparatus for remotely identifying incorrect versions of software resident on the locomotive.

Cost efficient railroad operation requires minimization of locomotive down time, and especially the avoidance of line-of-road locomotive failures. Failure of a major locomotive system can cause serious damage, require costly repairs, and introduce significant operational delays. A line-of-road failure is an especially costly event as it requires dispatching a replacement locomotive to pull the train, possibly rendering a track segment unusable until the disabled train is moved. Therefore, the health of the locomotive engine and its constituent sub-assemblies is of significant concern to the railroad.

Today's modern locomotive includes multiple microprocessors, each controlled by one or more software programs. Because there are literally dozens of such software programs on the locomotive, it is critical for operational and maintenance purposes to ascertain the version number of the software programs and ensure that this version number is correct. In some cases, certain software versions may be incompatible with other software running on the locomotive or a particular software version may not match the hardware configuration. Additionally, incorrect software versions can cause operational problems and delays in detecting the root cause of fault conditions. In fact, the root cause may simply be the incorrect software version. It is therefore critical to periodically determine whether the software version number is correct.

One apparatus for minimizing locomotive down time measures performance and fault-related operational parameters of the locomotive during operation. Analysis of this information can provide timely indications of expected and immediate component failures. With timely and nearly continuous access to locomotive performance data, it is possible for locomotive repair experts to predict and/or prevent untimely failures.

Such an apparatus is described and claimed in the commonly owned patent application entitled, "On-Board Monitor for a Railroad Locomotive". This application bears the application Ser. No. 09/696,368 and was filed on Oct. 25, 2000. The on-board monitor collects, aggregates, and communicates locomotive performance and fault related data from an operating locomotive to a remote monitoring and diagnostic center. The data is collected periodically or as required by various triggering events that occur on the locomotive during operation. Generally, anomalous or fault data is brought to the attention of the locomotive operator directly by these control systems, but the locomotive itself lacks the necessary hardware and software elements to diagnose the fault. It is therefore advantageous to utilize an on-board monitor to collect and aggregate the information and at the appropriate time send it to a remote monitoring and diagnostic service center. Upon receipt of the performance data at the remote site, data analysis tools operate on the data to identify the root cause of potential or actual faults. Experts in locomotive operation and maintenance also analyze the received data to develop repair recommendations for preventative maintenance or to correct faults. Historical anomalous data patterns can be important clues to an accurate diagnosis and repair recommendation. The lessons learned from failure modes in a single locomotive can also be applied to similar locomotives in the fleet so that the necessary preventive maintenance can be performed before a line-of-service break down occurs. When the data analysis process identifies incipient problems, certain performance aspects of the locomotive can be derated to avoid further system degradation and further limit violations of operational thresholds until the locomotive can undergo repair at a repair facility.

BRIEF SUMMARY OF THE INVENTION

Before describing in detail the particular configuration apparatus and method in accordance with the present invention, it should be observed that the present invention resides primarily in a novel combination of processing steps and hardware related to a software configuration technique. Accordingly, these processing steps and hardware components have been represented by conventional processes and elements in the drawings, showing only those specific details that are pertinent to the present invention so as not to obscure the disclosure with structural details that will be readily apparent to those skilled in the art having the benefit of the description herein.

The on-board monitor aboard the locomotive monitors and collects data indicative of the vehicle operation from several locomotive control systems. In addition to operational parameters, the on-board monitor retrieves the identification number for various software programs on board the locomotive. The software identification information is sent to the remote monitoring and diagnostic center where it is checked against the expected configuration information. Mismatches are notated for resolution by experts in locomotive operation and maintenance resident at the remote monitoring and diagnostic center.

BRIEF DESCRIPTION OF THE DRAWINGS

The present invention can be more easily understood and the further advantages and uses thereof more readily apparent, when considered in view of the description of the preferred embodiments and the following figures, in which.

DETAILED DESCRIPTION OF THE PREFERRED EMBODIMENTS

Figure 1:
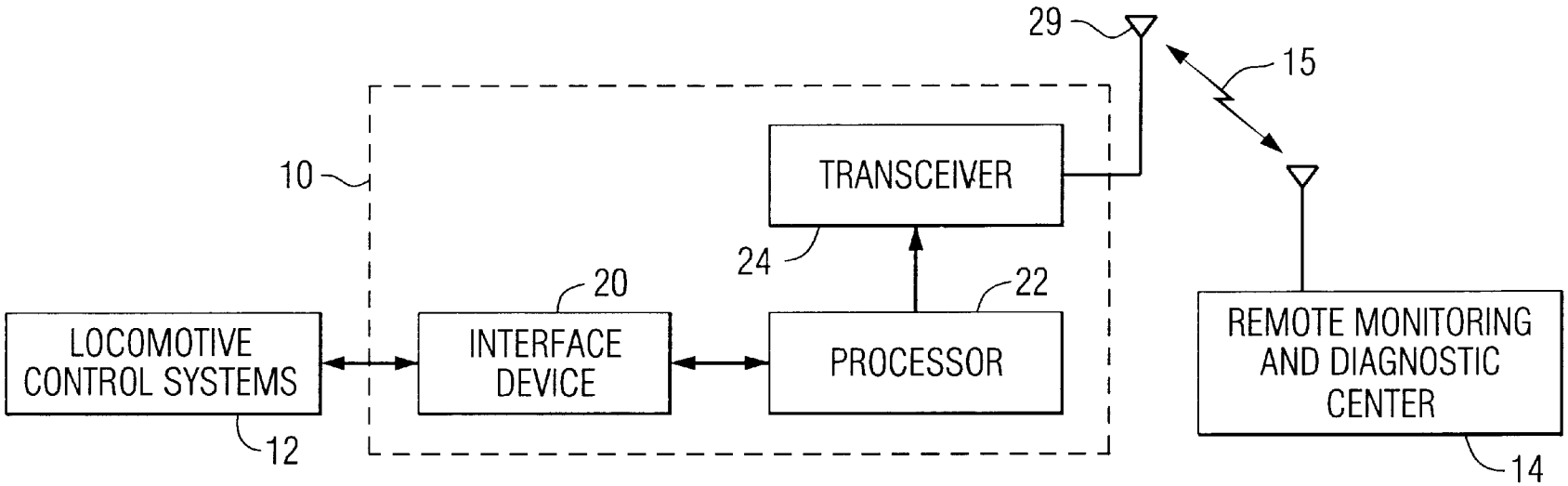
FIG. 1 is a block diagram of the essential elements of an on-board monitor that collects the software version number according to the teachings of the present invention.

FIG. 1 illustrates the environment in which the present invention operates as applied to a locomotive. A locomotive on-board monitor is coupled to a plurality of locomotive control systems, depicted generally by reference character 12. These locomotive control systems can include: a locomotive controller, an excitation controller, an auxiliary equipment controller, and a propulsion system controller. The specific nature and function of the controllers are not germane to the present invention, except to the extent that the on-board monitor 10 monitors various parameters associated with these control systems. The on-board monitor 10 is described in greater detail in commonly-owned patent application entitled, "On-Board Monitor for a Railroad Locomotive", bearing application Ser. No. 09/696,368. The data collected by the on-board monitor 10 provides important locomotive performance and status information, which is analyzed at a remote monitoring and diagnostic center 14 to identify active faults, predict incipient failures, and provide timely information about existing operating conditions.

The on-board monitor 10 serves the functions of a signal acquisition, signal conditioning, data processing, and logging instrument that provides status information to the remote monitoring and diagnostic center 14 via a bi-directional communication path 15. Certain parametric and fault-related information gathered by the on-board monitor 10 is collected and stored as data in raw data files. Other data collected generates operational statistics and is stored as statistical parameters. Both the raw data files and the statistical data files are downloaded to the remote monitoring and diagnostic center 14 on a periodic basis. Likewise, operational and reconfiguration commands are are uploads to the on-board monitor 10 from the remote monitoring and diagnostic center 14.

The data analysis processes carried out at the remote monitoring and diagnostic center 14 are discussed in detail in the commonly-owned patent applications entitled "Diagnosis and Repair System", bearing application Ser. No. 09/644,421, filed on Aug. 23, 2000, and "Apparatus and Method for Performance and Fault Data Analysis", bearing application Ser. No. 09/629,597, filed on Jul. 31, 2000. These applications are herein incorporated by reference.

The on-board monitor 10 comprises an interface device 20, a processor 22, and a transceiver 24. The interface device 20 communicates bi-directionally with the various locomotive control systems 12 and the processor 22. The interface device 20 performs typical signal acquisition and conditioning processes, as is well known to those skilled in the art. In one embodiment, the processor 22 includes a hard drive, input devices such as a keyboard or a mouse, magnetic storage media (e.g., tape cartridges or disks), optical storage media (e.g., CD-ROM's) and output devices such as a display and a printer. The processor 22 controls operation of the on-board monitor 10 including especially the control over the nature and frequency at which data is collected from the locomotive control systems 12. The modem 24, under control of the processor 22, communicates with a transmitter/receiver device in the remote monitoring and diagnostic center 14 via an antenna 29. As is known to those skilled in the art, there are a number of appropriate communication schemes for implementing this link, including: cellular telephone, satellite phone, or point-to-point microwave. Since the locomotive spends considerable time in transit hauling either freight or passengers, sometimes in remote regions, it has been observed that a satellite-based link provides the most reliable communications medium between the locomotive and the remote monitoring and diagnostic center 14.

Figure 2:
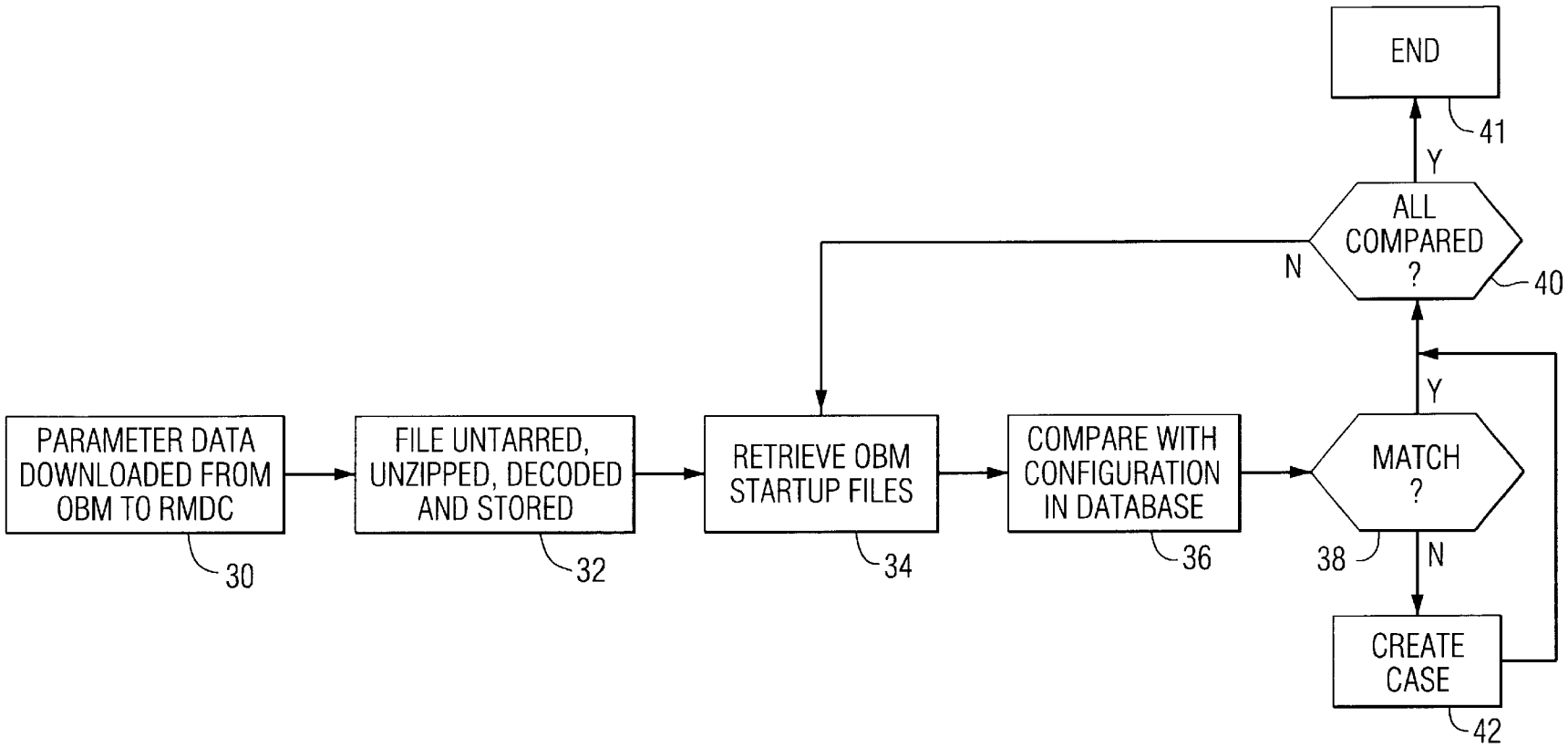
FIG. 2 is a flow chart illustrating operation of the software version comparison technique associated with the present invention.

As taught by the present invention, FIG. 2 illustrates the process of comparing the software configuration version on board the locomotive with those versions identified in the locomotive configuration file at the remote monitoring and diagnostic center. This process is executed by the processor 22. At a step 30, parametric data is downloaded from the on-board monitor 10 to the remote monitoring and diagnostic center 14. This data includes not only the version number for locomotive software, but also locomotive operational data for analysis at the remote monitoring and diagnostic center 14. Exemplary software programs for which the version numbers are checked include inverter control software, propulsion system control software, and auxiliary system control software. The nature and function of these software programs are well known to those skilled in the art. At a step 32, the files are untarred, unzipped, decoded and stored at the remote monitoring and diagnostic center 14. At a step 34, the on-board monitor start-up files, where the software version configuration information is stored, are retrieved. The program then opens the start-up file for the first selected on-board monitor and reads the values that identify the railroad customer, the locomotive road number, and other identification parameters. At a step 36, the program retrieves the software version numbers for the customer and locomotive identified at the step 34, from a configuration file at the remote monitoring and diagnostic center 14. Further, at the step 36, the expected software configuration version numbers are compared with the actual software configuration version numbers. At a decision step 38, a determination is made as to whether these version numbers match. If the version numbers match, processing moves to a decision step 40. Here, the system determines whether there are any other files in the on-board monitor start-up file still awaiting comparison. If all the files have not yet been compared, then processing moves from the decision step 40 back to the step 34, where another software version number is retrieved. If there are no further files to compare, then processing moves to the end step 41.

Returning to the decision step 38, if the actual value of the software version does not match the expected value, then processing moves to a step 42 where a case is created at the remote monitoring and diagnostic center 14. This case is added to the work queue where it will eventually be analyzed for the process of formulating a recommendation. In most situations, this recommendation will simply involve upgrading the software version at the locomotive. After the creation of a case at the step 42, processing returns to the decision step 40. Note that while there are several software configuration version numbers stored in the on-board monitor start-up file, only one case will be created for each start-up file, regardless of the number of version mismatches within that file. Once all values in the first file have been retrieved and compared, the program then opens the next on-board monitor start-up file, with software version information from another on-board monitor 10 aboard a different locomotive. This process of opening files and reviewing the software version numbers continues until all the files in the directory have been processed. Also, if the program is unable to process all the values within a file, then a descriptive error message is created, for later analysis by a locomotive expert at the remote monitoring and diagnostic service center 14.

While the invention has been described with reference to a preferred embodiment, it will be understood by those skilled in the art that various changes may be made and equivalent elements may be substituted for elements thereof without departing from the scope of the invention. In addition, modifications may be made to adapt a particular situation more material to the teachings of the invention without departing from the essential scope thereof. Therefore, it is intended that the invention not be limited to the particular embodiment described as the best mode contemplated for carrying out this invention, but that the invention will include all embodiments falling within the scope of the appended claims.

What is claimed is:

1. For use with a mobile asset comprising a plurality of operational systems, wherein at least one of the plurality of operational systems executes software code identified by a software code version identifier, and wherein the mobile asset is in selectable communication with a remote site, a method for determining whether the software code version is correct, said method comprising the steps of:

(a) from the mobile asset, transmitting a software code version identifier for the at least one of the plurality of operational systems and transmitting a mobile asset identifier, wherein the software code version identifier represents the software code version executing on the mobile asset (b) at the remote site, receiving the software code version identifier and the mobile asset identifier;

(c) at the remote site, determining the correct software code version for the identified mobile asset;

(d) at the remote site, comparing the correct software code version with the software code version as identified by the software code version identifier for the at least one of the plurality of operational systems; and (e) generating an error signal if the result of step (d) indicates the software code version executing on the mobile asset is not correct.

2. The method of claim 1 further comprising a step:

(f) analyzing the mismatch between the software code version executing on the mobile asset and the correct software code version for the purpose of creating a recommendation to resolve the mismatch.

3. The method of claim 1 further comprising a step:

(f) from the remote site, transmitting the correct software code version to the mobile asset.

4. The method of claim 1 wherein the mobile asset is a railroad locomotive.

5. The method of claim 1 wherein the step (c) further comprises consulting a software configuration file for the identified mobile asset.

6. The method of claim 1 wherein the step (a) further comprises transmitting from the mobile asset parametric operating information regarding the operational status of one or more of the plurality of operational systems.

7. An apparatus for use with a mobile asset comprising a plurality of operating systems, wherein at least one of the plurality of operating systems executes software code identified by a software code version identifier, and wherein the mobile asset is in selectable communications with a remote site, wherein said apparatus comprises:

(a) a transmitter for transmitting a software code version identifier for the at least one of the plurality of operational systems and for transmitting a mobile asset identifier, wherein the software code version identifier represents the software code version executing on the mobile asset;

(b) a receiver at the remote site for receiving the software code version identifier and the mobile asset identifier;

(c) at the remote site, an identifier having a data base for determining the correct software code version for the identified mobile asset;

(d) at the remote site, a comparator for comparing the correct software code version with the software code version executing on the mobile asset; and (e) a signal generator for generating an error signal if the result of step (d) indicates the software code version executing on the mobile asset is not correct.

8. The apparatus of claim 7 wherein the data base at the remote site comprises a software configuration file for the identified mobile asset.

9. The apparatus of claim 7 further comprising an on-board monitor for monitoring the plurality of operating systems and for transmitting operating parametric information to the remote site.

* * * * *